United States Patent [19]

Targetti

[11] Patent Number: 4,633,624

[45] Date of Patent: Jan. 6, 1987

[54] ASSEMBLY OF COMPONENTS TRESTLE TYPE FOR OUTSIDE FITTINGS

[75] Inventor: Giampaolo Targetti, Florence, Italy

[73] Assignee: Targetti Sankey S.p.A., Florence, Italy

[21] Appl. No.: 712,551

[22] Filed: Mar. 15, 1985

[30] Foreign Application Priority Data

| | | | |
|---|---|---|---|
| Sep. 18, 1984 | [IT] | Italy | 11825/84[U] |
| Sep. 18, 1984 | [IT] | Italy | 11826/84[U] |
| Sep. 18, 1984 | [IT] | Italy | 11827/84[U] |
| Sep. 18, 1984 | [IT] | Italy | 11828/84[U] |
| Sep. 18, 1984 | [IT] | Italy | 11829/84[U] |

[51] Int. Cl.[4] ..... E04H 12/00

[52] U.S. Cl. ..... 52/28; 52/40; 52/86; 52/648; 403/310

[58] Field of Search ..... 52/86, 638, 639, 641, 52/644, 648, 651, 28, 40; 403/302, 310, 311, 312

[56] References Cited

U.S. PATENT DOCUMENTS

| | | | |
|---|---|---|---|
| 34,769 | 3/1862 | Northrup | 403/310 |
| 2,693,195 | 11/1954 | Frieder et al. | 52/641 X |
| 3,371,458 | 3/1968 | Sturgill | 52/648 |
| 3,670,471 | 6/1972 | Smith | 52/638 |

FOREIGN PATENT DOCUMENTS

| | | | |
|---|---|---|---|
| 5081 | 5/1879 | Fed. Rep. of Germany | 403/312 |
| 419650 | 8/1974 | U.S.S.R. | 403/310 |

*Primary Examiner*—Alfred C. Perham
*Assistant Examiner*—Jean M. LaKemper
*Attorney, Agent, or Firm*—Hopgood, Calimafde, Kalil, Blaustein & Judlowe

[57] ABSTRACT

A support assembly includes a plurality of linear supports each of which is formed of at least three longitudinal members juxtaposed in a predetermined substantially parallel relationship to one another networked together with brace means. At least two linear supports are connected by way of a set of curved connecting bars to give a shaped overall structure. In other aspects of the invention mounting brackets for use in connection with, for example, the inventive assembly are disclosed. One bracket is for mounting atop a triangular section while another bracket is substantially triangular at one end and extends laterally to a common support point distal to a substantially vertical supporting member.

6 Claims, 18 Drawing Figures

ASSEMBLY OF COMPONENTS TRESTLE TYPE FOR OUTSIDE FITTINGS

TECHNICAL FIELD

The invention concerns an assembly for fittings for outside locations, such as gardens, which consists of trestle type components with polygonal cross section, longitudinal beams at the corners. The beams are connected with slanting tension bars such that the components form stanchions, brackets, arches and terminals, and of lighting elements that can be associated with the above reticular components.

SUMMARY OF INVENTION

In practice the reticular components can be triangular trestle type, formed by three longitudinal beams at the corners and by slanting wind bracing tension bars; these components are to be coupled by joints between the longitudinal beams in order to form vertical, horizontal and molded structures.

A basic element can be formed by an end plate rigidly attached to the coplanar ends of the longitudinal beams and made further rigid to the stanchion by means of square gussets welded to the above plate and to the above longitudinal beams.

The longitudinal beams—placed at the vertices of a polygon in the cross section—have molded ends in order to fit, by means of junction couplings, the ends of the longitudinal beams of an adjacent component. In order to allow the formation of cambers and broken line structures with limited mutual slant, joints are provided slightly different in length from one another and suitable for engaging the ends of two corresponding longitudinal beams of two components to be connected with each other to form an angle. These joints are of at least two different lengths in order to connect two adjacent components to form a relative angle of about 10°.

BRIEF DESCRIPTION OF DRAWINGS

The drawing shows possible ways for realizing the components and the structure in various assemblings. In particular.

DETAILED DESCRIPTION

The invention concerns an assembly for fittings based upon a reticular structure consisting of a plurality of main components which is composed of junction couplings in order to form structures of different types and for different purposes and to achieve determined aesthetic configurations. Each main component, similar to girders, different in length, consists of at least three longitudinal beams 1 (FIG. 1), placed at the vertices of a polygon in the cross section and connected with each other by slant tension bars 3 as wind bracings, which stiffen the so formed reticular structure; generally the longitudinal beams are cylindrical.

The ends of longitudinal beams 1 of a component are in the same transverse plane limiting each end of a main component; the ends of these longitudinal beams are molded in order to fit the ends of the longitudinal beams of an adjacent main component, junction couplings being provided for the concurring and coaxial ends of the longitudinal beams.

Figure 1:
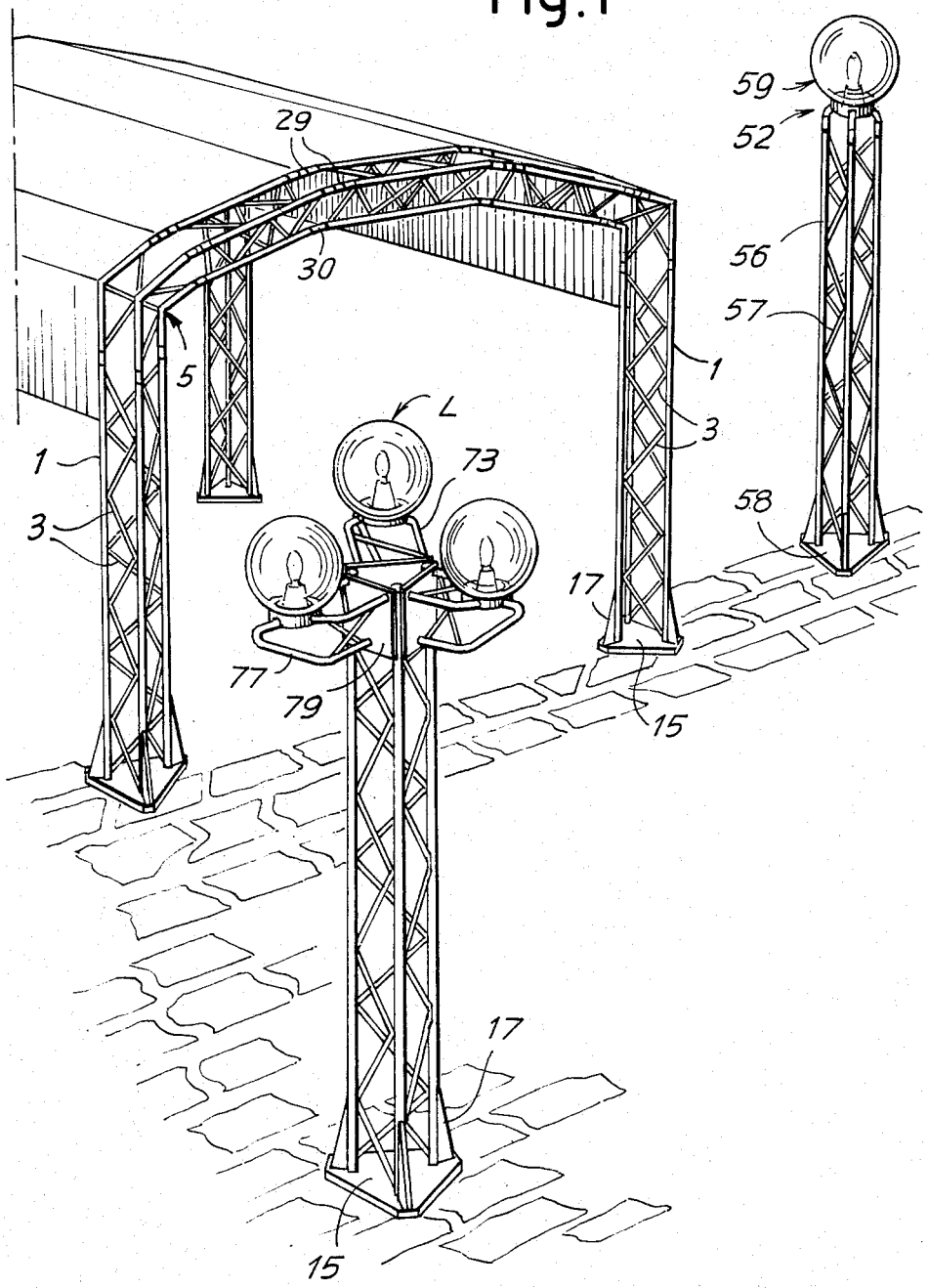
FIG. 1 shows a perspective view of several structures.
Figure 2:
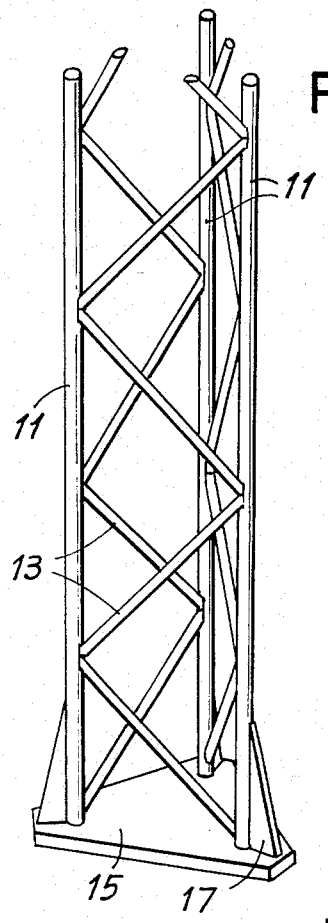
FIG. 2 shows an overall perspective view of a trestle type stanchion with its base.
Figure 3:
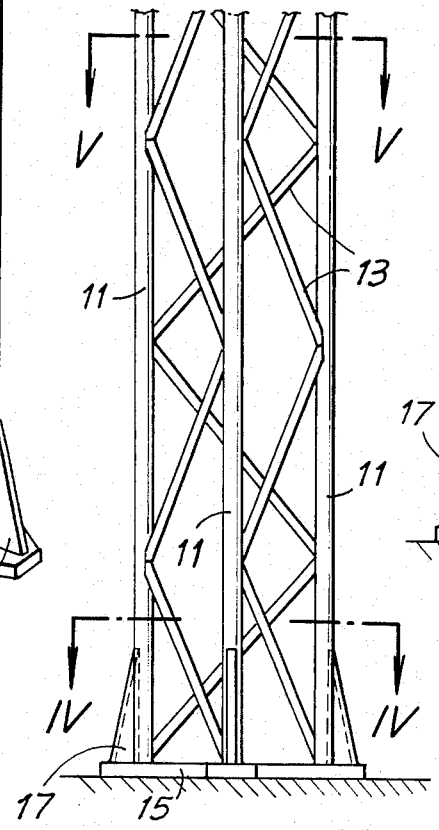
FIGS. 3, 4 and 5 shows a lateral view according to arrow III of FIG. 4, and two sections according to IV—IV and V—V of FIG. 3.
Figure 6:
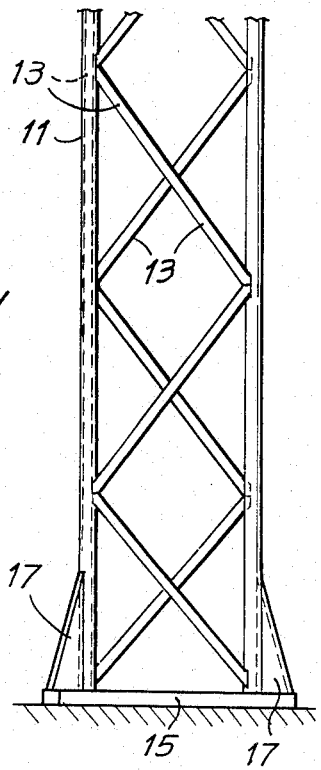
FIG. 6 shows a lateral view according to arrow VI of FIG. 4.
Figure 4:
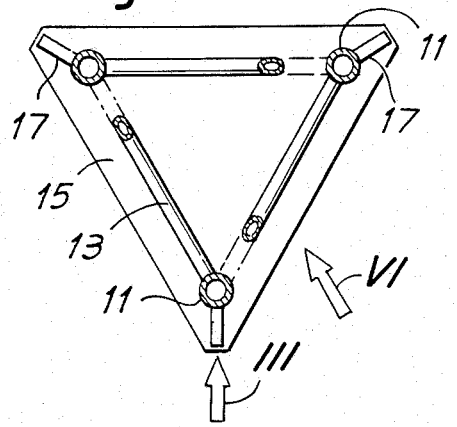
Figure 5:
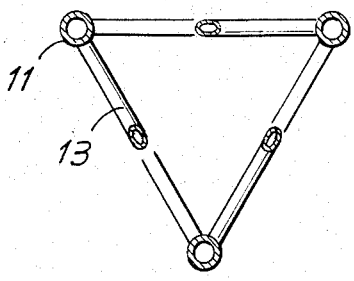
Figure 7:
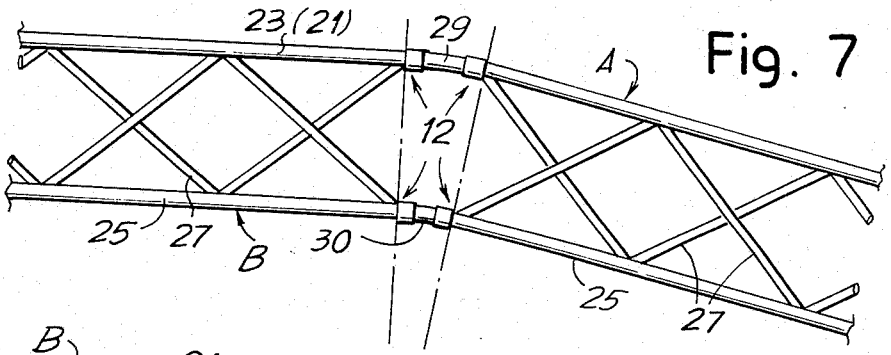
FIG. 7 shows a lateral view of the connection of two adjacent straight line components with mutual slant.

In addition to the above main.components, that represent girders or portions of straight line girders, other elbow-shaped joint components of various types are provided, such as those 5 of FIG. 1.

Even with many types of joint components, there are not many possibilities of combinations for forming structures different in shape, while on the other hand the joint components are too cumbersome and expensive to allow an adequate number of possibilities of giving shape to a complex reticular structure. The joint components involve for the most part the formation of very acute angles and up to the present time it has not been possible, for instance, to form centerings with limited curving, that is with considerable curving radius, or to form broken line structures with an equivalent development; instead, this is requested specially when the reticular structures we are considering have to be placed for outside rather than for inside fittings, where the development of the structure is generally square, in order to reproduce the development of the floors, walls and ceilings. This problem is solved according to what is shown in FIGS. 7 to 10.

According to FIGS. 2 to 6, a trestle type stanchion consists of three longitudinal beams 11 placed triangularly in the cross section (the triangle can be isosceles or even equilateral); the connection of the three longitudinal beams is trestle type formed by tension bars 13 slanting and orientated in the same way on the three fronts of the stanchion as defined by the three beams 11.

At the lower end of the stanchion thus formed, a base plate 15 is provided, shaped and orientated in most cases according to the triangular location of the beams 11. In order to stabilize the connection of the base plate to the stanchion, connection square gussets 17 are provided, welded—or connected in an equivalent way—with a corner edge to the relevant beam 11 and with the adjacent orthogonal corner edge to the plate 15. The stanchion thus formed is suitable for the outside reticular structures and for lamp posts and similar.

According to what is illustrated in FIGS. 7 to 10, with 21, 23 and 25 are indicated longitudinal beams belonging to two reticular components A and B to be connected with each other with a small mutual slant.

The reticular structure of each component A and B is completed by the tension bars, that is by wind bracings 27, that are suitably located both as to structural strength and from an aesthetic point of view. The longitudinal beams 21, 23, 25 are located at the vertices of an isosceles or equilateral triangle in the cross section; the three ends of the longitudinal beams of each component A and B are placed in the same transverse plane.

The ends of the confluent longitudinal beams are connected with each other with a slant by using—see drawing—a couple of joints 29 having the same higher length and by using a joint 30 whose length is slightly lower, having both joints 29 to connect the corresponding ends of beams 21 and 23, while joint 30 connects the ends of the two beams 25.

The junction couplings to connect joints 29 and 30 with the ends of the longitudinal beams 21, 23, 25 will be suitably molded in order to utilize the same moldings which serve for the connection of the structure reticular components or girders; these junction couplings will also consent the mutal slant between the longitudinal beams. The joints will be slightly curved or bent.

Figure 8:
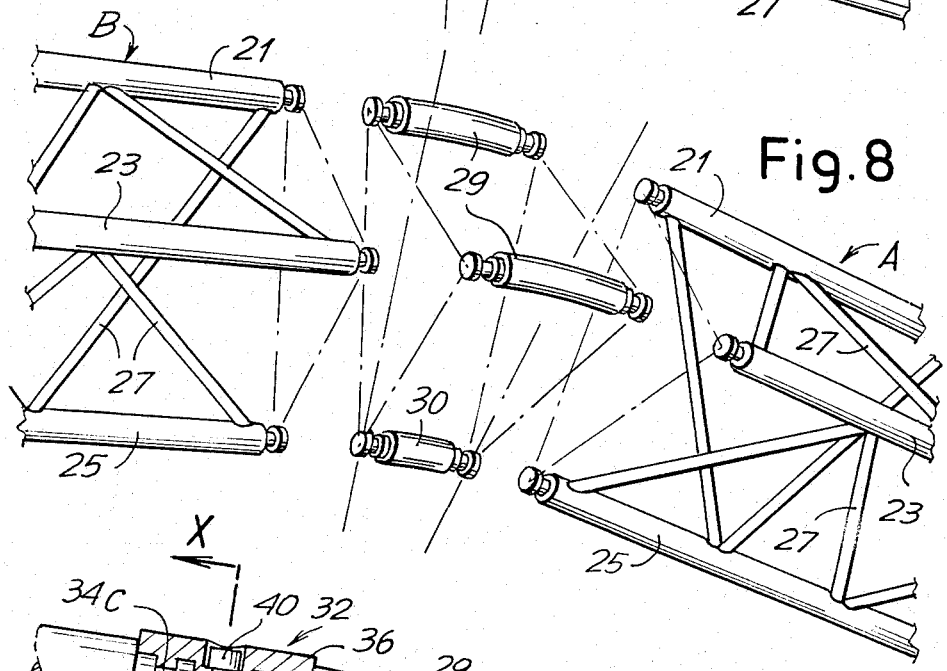
FIG. 8 shows an exploded view of the components.

In FIG. 8 the curve obtainable by joints 29 and 30 is provided in order to form the concavity at the side of the single longitudinal beam 25. By reversing the position of joints 29 and 30, that is by using a longer joint 29 to connect the longitudinal beams 25, 25 of the two components A and B and two shorter joints 30 to connect the longitudinal beams 21,21 and 23,23 of the two components A and B, it is possible to achieve an opposed curve, that is an opposed slant between components A and B, with respect to the slant shown in FIG. 8.

Figure 9:
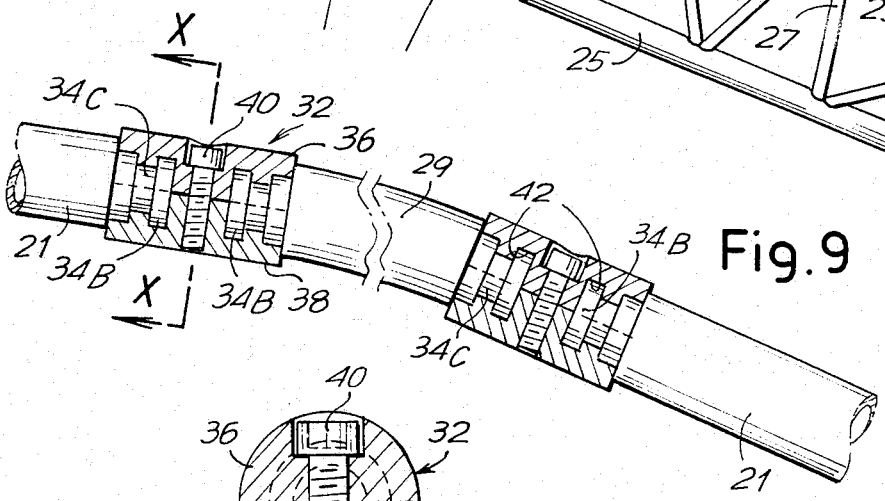
FIG. 9 shows the enlargement of a curved joint connected by junction couplings to the ends of the longitudinal beams of two adjacent components corresponding to one another.
Figure 10:
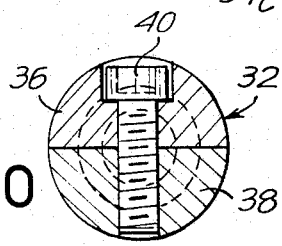
FIG. 10 shows a cross section according to line X—X of FIG. 9.

FIGS. 9 and 10 show the design of a coupling suitable for connecting joints 29 and 30 to the longitudinal beams. In FIG. 9, as an example, a joint 29 (with full circular section) is shown as connected to beams 21 (both with full circular section) by couplings 32. As mentioned above, couplings 32 shall be suitably molded in order to utilize the moldings for the mutual connection of the structure components. Both the ends of beams 21 and those of joint 29 show a molded extension, consisting in practice of a cylindrical portion 34B interrupted by an annular groove 34C. Essentially each coupling 32 consists of two semicylindrical parts 36 and 38 substantially symmetrical in respect of their coupling plane. These two parts can be coupled by bolt 40, perpendicular to the coupling plane; the head of the bolt is lodged in its proper seat as provided in part 38. Each part 36 and 38 shows on the plane coupling surface two hollows 42 molded in order to fit the molding of the extensions 34B and 34C; therefore in the connection of parts 36 and 38 two seats exactly corresponding to the two extensions are formed. Couplings 32, once bolt 40 is tight, create a rigid connection between each beam 21 and joint 29, both axially and angularly.

Figure 11:
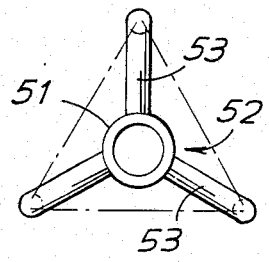
FIGS. 11 and 12 show the lateral and perspective view of a terminal.
Figure 12:
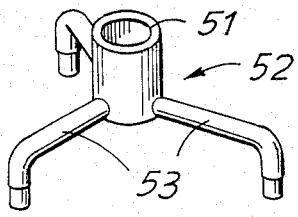
Figure 13:
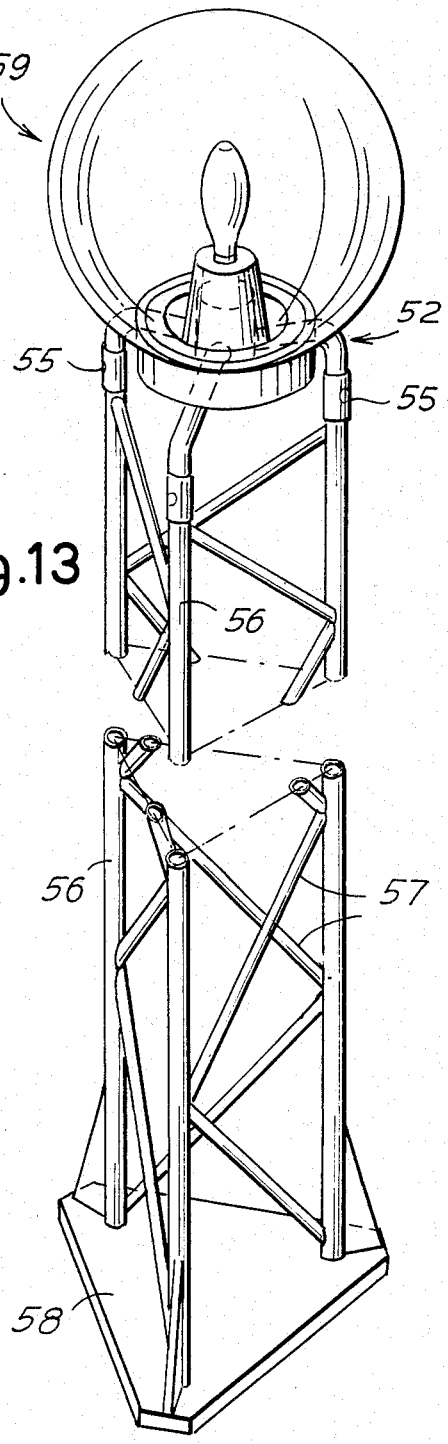
FIG. 13 shows the terminal connected to the end of a trestle type stanchion equipped with its base.
Figure 14:
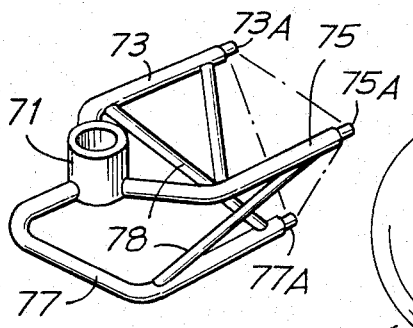
FIGS. 14, 15 and 16 shows a perspective, lateral and plan view of the bracket type support.

On FIGS. 11 to 13, item 51 indicates a nucleous, suitable to receive and to support a member to be combined with a terminal 52. From nucleous 51 rise—according to the drawing—three appendixes 53 radially orientated and slightly slanting downwards (at least at the ends). These ends of the appendixes 53 are suitable for connecting by couplings 55 (FIG. 13) the longitudinal elements 56 of a trestle type stanchion with wind bracings 57, which is shown in FIG. 13 and rises from an anchorage beam 58. The stanchion is designed as in other previous examples.

Terminal 52, formed by pieces 51, 53 is suitable for supporting a member serving several purposes including those of an aesthetic nature, such as a lamp 59 as shown in FIG. 13.

The terminal is particularly suitable for usage in outside structures, when lamp-posts and similar are requested.

According to what is illustrated in FIGS. 14 to 18, a bracket type support includes a nucleous 71, designed to receive and support the lamp member or similar that the said support is required to uphold. From nucleous 71 extend two linear coplanar and symmetrical members 73,75, molded as shown in detail in FIG. 18, while a third intermediate linear element 77, molded by two bends, develops on the symmetry plane of the assembly, below nucleous 71. Slanting wind bracings 78 connect the three elements 73,75,77. The terminal portions of elements 73,75,77 are almost mutually parallel and the ends 73A, 75A, and 77A of these elements are located in a plane vertically orientated in the arrangement of the assembly. These ends 73A, 75A and 77A are substantially placed triangularly (the triangle is isosceles, in particular, equilateral) and are connected with plate 79 suitable for the installation on stanchion, trestle type or similar.

Figure 17:
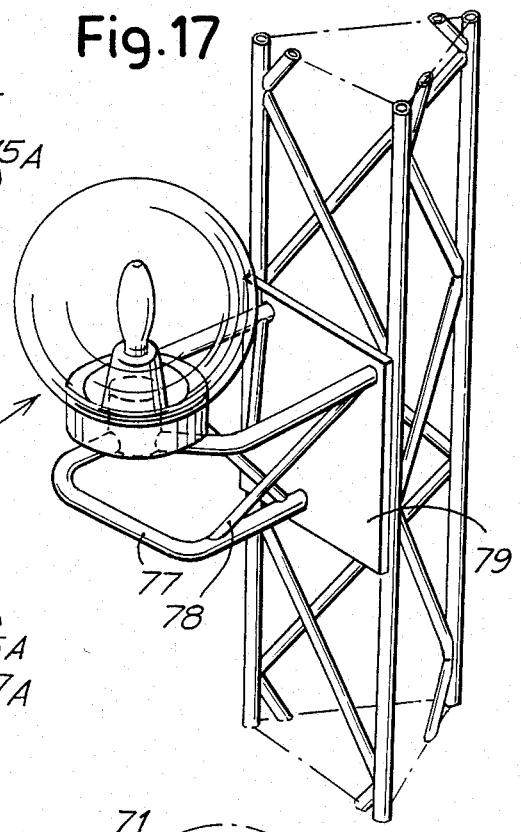
FIG. 17 shows a perspective view of a bracket type support connected to a trestle type stanchion.
Figure 15:
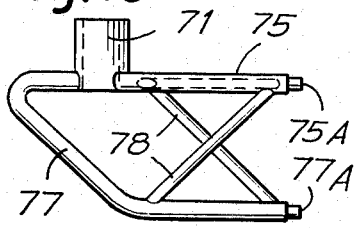
Figure 16:
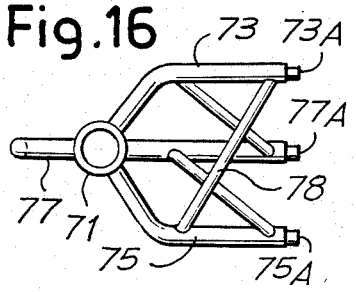

Nucleous 71 can receive and support a lamp as.indicated by L in FIG. 17.

Figure 18:
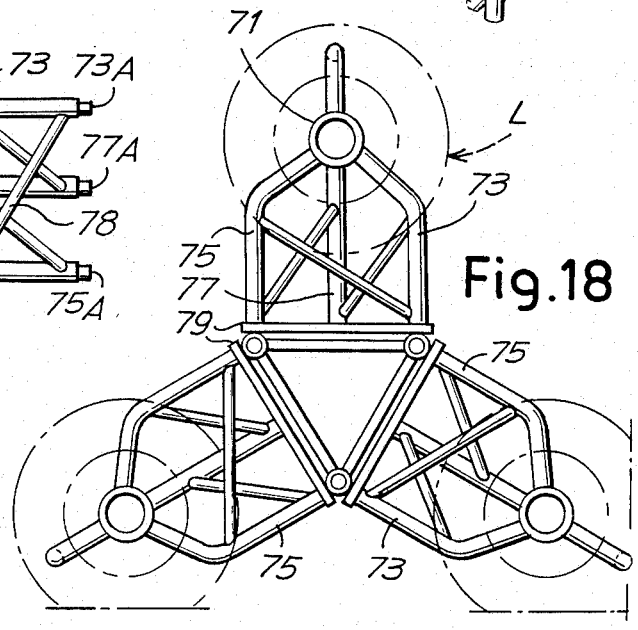
FIG. 18 shows three bracket type supports connected with trestle type stanchion with triangular cross section.

On the same stanchion, several supports, as described, can be fixed; a design of this kind is shows in FIG. 18, where trestle type stanchion develops with a triangular shape in the cross section and receives three bracket type supports, placed at the same level to form a triple lamp.

The drawing shows only one example of what has been designed, and can vary in shape and arrangement.

I claim:

1. A support assembly including a plurality of linear support members each of which is formed of at least three longitudinal beams juxtaposed in a predetermined substantially parallel spatial relationship and being networked together with brace members so that said beams terminate in a common plane at one end of said support members, said support members being of substantially identical cross section and having at the ends of their beams in said common plane coupling means, a set of coupling members for joining two of said support members in end-to-end curvilinear relationship to one another comprising at least two joining members of a first radius of curvature and a first length having at both ends means for connecting them to said coupling means of said beams and at least a third coupling member of a second radius of curvature and a second length, both ends of which are provided with means for connecting them with said coupling means of said beams, whereby said support assembly has at least two supporting members slantedly connected with respect to each other when said support members and coupling members are suitably joined.

2. The assembly according to claim 1, wherein said support members include three beams and are of substantially triangular cross section.

3. The assembly according to claim 2, wherein at least two adjacent support members are in slanted relationship of about ten degrees.

4. The assembly according to claim 1, wherein the ends of said beams and coupling members are substantially cylindrical, said coupling means and connecting means each comprise an annular groove and further comprising a coupling sleeve at each joint between the members and beams wherein said coupling sleeves are constructed and arranged to grip said grooves in order to hold said beams and coupling members together.

5. Support apparatus for exterior use comprising in combination:

at least a support assembly including a plurality of linear support members each of which is formed of at least three longitudinal beams juxtaposed in a predetermined substantially parallel spatial relationship and being networked together with brace members so that said beams terminate in a common plane at one end of said support members, said support members being of substantially identical cross section and having at the ends of their beams in said common plane coupling means, a set of coupling members for joining two of said support members in end-to-end curvilinear relationship to one another comprising at least two joining members of a first radius of curvature and a first length having at both ends means for connecting them to said couping means of said beams and at least a third coupling member of a second radius of curvature and a second length, both ends of which are provided with means for connecting them with said coupling means of said beams, whereby said support assembly has at least two support members slantedly connected with respect to each other when said support members and coupling members are suitably joined, and a light-supporting stanchion adjacent said support assembly capable of supporting a light fixture for casting light on said support assembly including a plurality of linear supports joined end-to-end, each of which includes three poles juxtaposed in triangular relationship with respect to each other and networked together with a plurality of bracing parts, and a light support for mounting atop said assembly comprising three bars provided with right angles at their outer portions centrally connected at a support point, said bars being constructed and arranged so that their lower extremes abut the upper portions of said poles of said linear supports upon mounting thereon.

6. Support apparatus for exterior use comprising in combination:

a support assembly including a plurality of libnear support members each of which is formed of at least three longitudinal beams juxtaposed in a predetermined substantially parallel spatial relationship and being networked together with brace members so that said beams terminate in a common plane at one end of said support members, said support members being of substantially identical cross section and having at the ends of their beams in said common plane coupling means, a set of coupling members for joining two of said support members in end-to-end curvilinear relationship to one another comprising at least two joining members of a first radius of curvature and a first length having at both ends means for connecting them to said coupling means of said beams and at least a third coupling member of a second radius of curvature and a second length, both ends of which are provided with means for connecting them with said coupling means of said beams, whereby said support assembly has at least two support members slantedly connected with respect to each other when said support members and coupling members are suitably joined, and a triangular support bracket mounted on a substantially vertical supporting stand member located adjacent said support assembly and capable of supporting a light fixture for casting light on said assembly, said bracket being configured to project laterally from said supporting stand member and comprising in combination a pair of forked upper support arms in parallel coplanar relationship to each other being joined at a support point disposed distally with respect to said vertical supporting stand member when said bracket is mounted thereon, said upper support arms having at one end means for engaging said supporting stand member at a first level, a third bi-level support arm triangularly disposed with respect to said upper forked arms and parallel thereto at one extremity which extremity is also provided with means for engaging said supporting member at a second level, said third support arm extending to said support point and bracing means connecting said upper beams to each other and further connecting the upper arms to said third bi-level arm at the portion thereof parallel to said upper beams.

* * * * *